United States Patent [19]

Selig

[11] 4,410,888

[45] Oct. 18, 1983

[54] COMPONENT FOR MODULE FOR PRESENTING ALPHA NUMERIC OR LIKE INFORMATION

[76] Inventor: Guenther Selig, 2138 Rugen Rd., Glenview, Ill. 60025

[21] Appl. No.: 267,022

[22] Filed: May 26, 1981

[51] Int. Cl.[3] ..... G08B 5/28

[52] U.S. Cl. ..... 340/815.05; 340/815.27; 340/815.29; 340/815.33

[58] Field of Search ..... 340/373, 378.4, 376, 340/383, 381, 380, 815.29, 815.27, 815.26, 815.05, 815.04, 815.33, 815.12

[56] References Cited

U.S. PATENT DOCUMENTS 4,015,255 3/1977 Wood ..... 340/381

4,215,338 7/1980 Selig ..... 340/373

4,318,098 3/1982 McGreevy ..... 340/815.04

4,327,357 4/1982 Skrobisch ..... 340/815.29

*Primary Examiner*—Glen R. Swann, III

*Attorney, Agent, or Firm*—Tilton, Fallon, Lungmus & Chestnut

[57] ABSTRACT

A component for an alpha-numeric or like module wherein the component includes a subframe to be installed as part of the module frame, the subframe having a front and rear with a shutter pivotally mounted on the rear, the subframe employing both permanent and electomagnetic means for causing the shutter to open, the subframe having a lens exposed by the shutter to direct light through the lens from an off-axis light source rearward of the subframe.

12 Claims, 11 Drawing Figures

FIG. 1
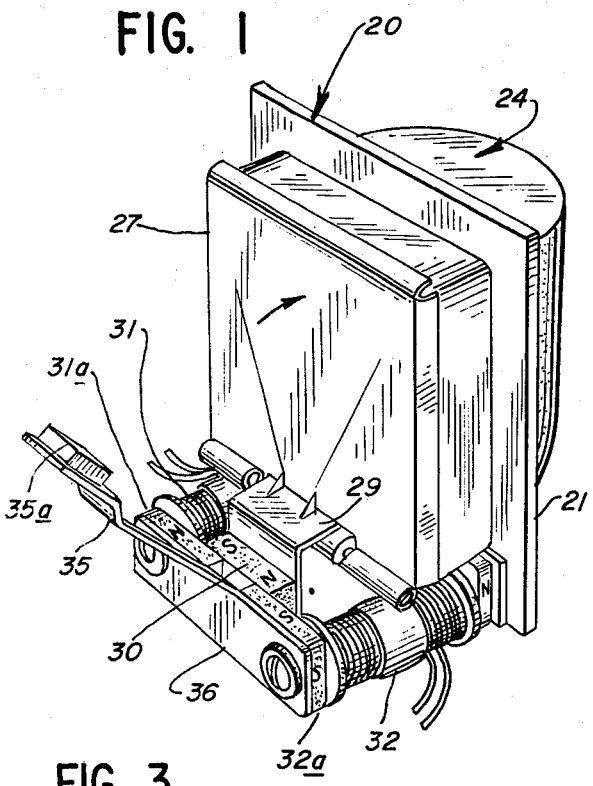
FIG. 2
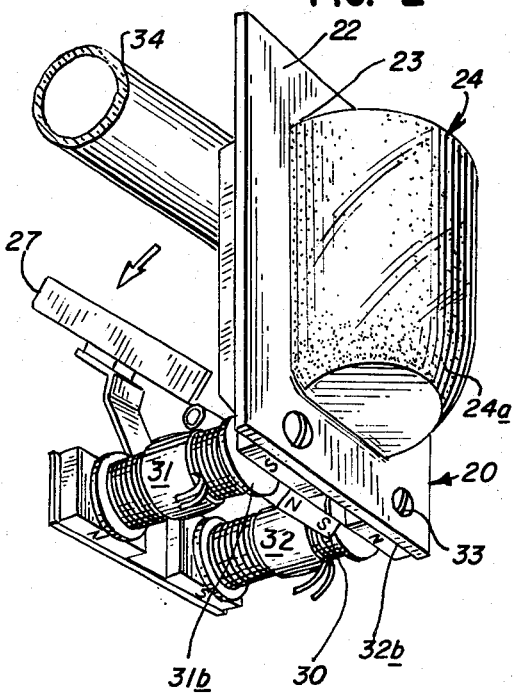
FIG. 3
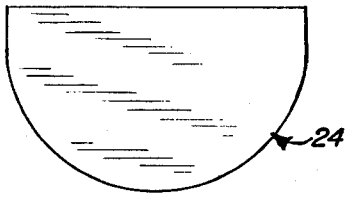
FIG. 4
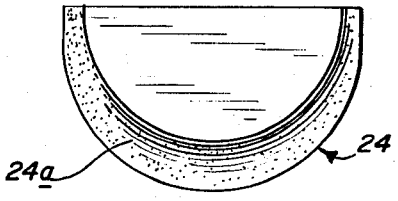
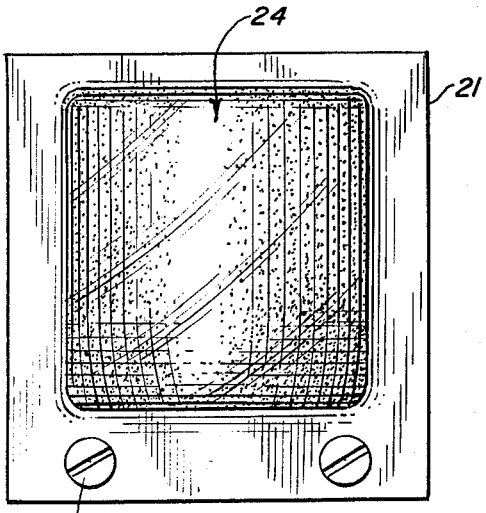
FIG. 5
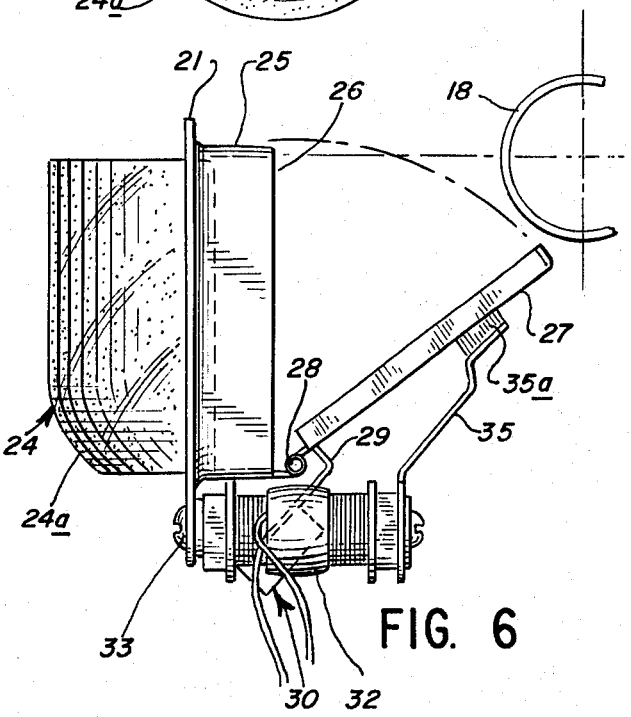
FIG. 6

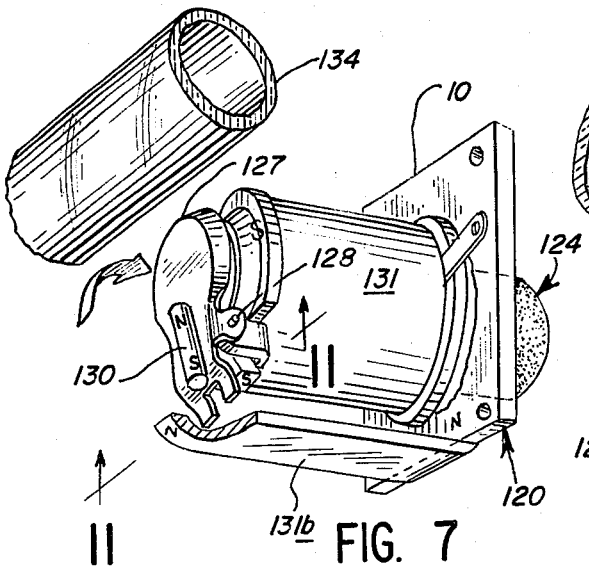
FIG. 7
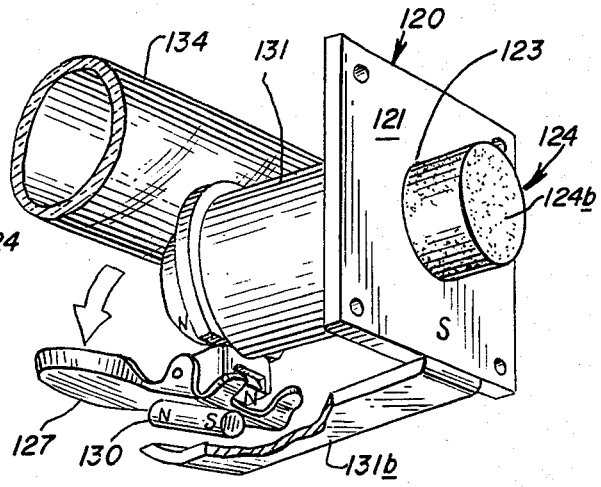
FIG. 8
FIG. 9
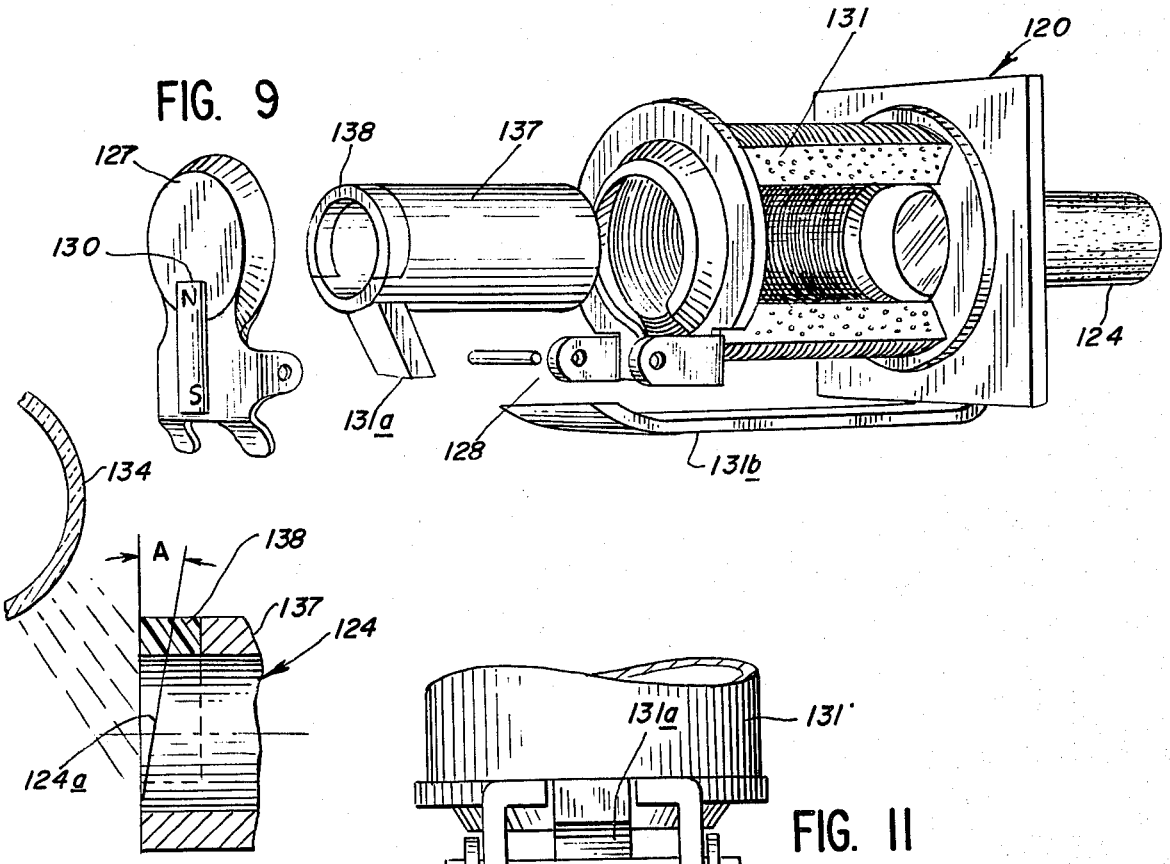
FIG. 10
FIG. 11

COMPONENT FOR MODULE FOR PRESENTING ALPHA NUMERIC OR LIKE INFORMATION

BACKGROUND OF INVENTION

This invention relates to a component for a module for presenting alpha numeric or like information and, more particularly, to a component which is an improvement on my earlier U.S. Pat. No. 4,215,338.

In the above mentioned patent, a novel operation was provided by having the permanent magnet on the shutter be opposed by a selectively actuatable electromagnet. This novel operation has proved quite advantageous but the illustrated embodiment in the above patent presented certain problems. By providing the shutters on the front side of the module frame, excellent access was provided on the rear of the module frame for delivering light from an illuminating means. However, the provision of the shutters on the front of the module frame tended to present a somewhat cluttered appearance and, in certain instances, could interfere with full appreciation of the alpha numeric information presented by the module.

SUMMARY OF INVENTION

This problem has been solved by the instant invention in a novel way by providing the shutters of the module components on the rear side of the frame in a fashion so as not to interfere with the light emanating from the fluorescent illuminating source. More particularly a lens has been introduced into each component or element and constructed and arranged so as to compensate for off-axis or off-center mounting of the illuminating means. This has resulted in the ability to fill the entire visible surface with brilliant light as soon as the shutter is open. It will also be appreciated that the absence of mechanical parts on the front of the display provides a cleaner view for the observer and that the location of the shutters inside the display enclosure provides them with greater protection from the elements. Also, the external protective clear plastic pane previously thought desirable is no longer required thereby obliviating any concern of sun glare of distractive reflections of ambient light while the addition of a light transmitting and scattering lens produces a display of greater brilliance at wider angular viewing abilities.

By comparison with the illustrated embodiment of the above-mentioned patent, the addition of a lens also reduces the angle to which the shutter must be opened for optimum light transmission by about 20%, thereby reducing mechanical wear and effecting a much more rapid cycling ability of the shutter. In addition, the availability of such wide speed ranges also allows for the display of any type of animated presentation which are comprehended herein by the designation alpha numeric information.

Other advantages and objects of the invention may be seen in the details of the ensuing description.

BRIEF DESCRIPTION OF THE DRAWINGS

The invention is described in conjunction with the accompanying drawing, in which FIG. 1 is a perspective view of one embodiment of component of the invention as seen from the rear;

FIG. 2 is a view similar to FIG. 1 but taken from the front and also showing in fragmentary form a fluorescent light source;

FIG. 3 is a top view of the lens portion of FIGS. 1 and 2;

FIG. 4 is a bottom view of the lens;

FIG. 5 is a front elevational view of the component of FIGS. 1 and 2;

FIG. 6 is a side elevational view of the component of the preceding views;

FIG. 7 is a view similar to FIG. 1 but of another embodiment of the invention;

FIG. 8 is a front perspective view of the embodiment of FIG. 7;

FIG. 9 is an exploded view of the component of FIGS. 7 and 8;

FIG. 10 is a fragmentary sectional view showing the relationship of the illuminating source and the lens; and FIG. 11 is a sectional view taken along the sight line 11—11 applied to FIG. 7.

DESCRIPTION OF THE PREFERRED EMBODIMENTS

In the interest of clarity and brevity, only the component portion of the module is illustrated in the drawing. It will be appreciated, however, that the components hereof are intended for installation in displays of the nature shown and described in U.S. Pat. No. 4,215,338 and the disclosure thereof is hereby incorporated herein by express reference. More particularly, omitted from the drawing hereof is the total module which is normally made up of a plurality of components or elements arranged in rows and columns. Thus, the components of the instant invention are adapted to be used in the module arrangement of the above-mentioned patent.

Referring now to FIG. 1, the numeral 20 designates generally the component subframe which is adapted to be integrated into the frame (not shown) of the module (also not shown).

In the illustration given in FIGS. 1-6, the subframe 20 inlcudes a panel 21 of generally rectangular construction and is equipped with a front face 22 (see FIG. 2) which is apparent from the viewing side. The panel 21 is equipped with a central opening as at 23 for the receipt and mounting of a lens generally designated 24—still referring to FIG. 2.

As can be best appreciated from a consideration of FIG. 6, the panel 21 is formed to provide a perimetric flange 25 extending rearwardly from the panel 21 and which simultaneously provides additional support for the lens 24 while providing a seat 26 for the shutter 27.

The shutter 27 is hingedly supported as at 28 (still referring to FIG. 6) on an extension of the perimetric flange 25.

A strap 29 depends from the shutter 27 and carries a permanent magnet generally designated 30. This also can be seen in the central lower portion of FIG. 1.

To provide for the pivoting action of the shutter 27, a pair of parallel spaced-apart electromagnets 31 and 32 are provided. These are secured to the subframe 20 by means of bolts 33. Each electromagnet 31 and 32 is equipped with the usual pole pieces at the ends thereof. Pivoting of the shutter 27 to the open condition (compare FIGS. 1 and 2) permits light from the fluorescent illuminating source 34 to enter the lense 24 and thus be visible from the front. The illuminating source 34 is suitable supported on the frame (not shown) of the module so as to service a plurality of horizontally-aligned components.

OPERATION

In the operation of the invention and with reference first to FIG. 1, the shutter 27 is being held in the closed position by the attraction of the magnet 30 to the outer pole pieces 31*a* and 32*a* of the electromagnets 31 and 32, respectively. Upon energizing the coils of the electromagnets 31 and 32, the pole pieces 31*a* and 32*a* are subjected to a magnetic field of identical polarity of the permanent magnet 30, thereby causing a repulsion. Resulting from this repulsion, the permanent magnet 30 starts moving out of the repulsion field and, as it is attached to the shutter 27, causes the shutter 27 to swivel around the hinge connection 28, thus causing the shutter to open to the condition illustrated in FIGS. 2 and 6. At the same time the permanent magnet is attracted by the inner pole pieces 31*b* and 32*b*—see FIG. 2. It will be appreciated that energization of the coils of the electromagnets 31 and 32 need be only an electrical pulse of a short duration, for as soon as the shutter is open to its fullest extent, it comes to rest upon the felt pad 35*a* of the backstop 35 mounted on the cross bar 36 (see FIG. 1) connecting the outer ends of the electromagnetics 31 and 32.

In the open position (see FIGS. 2 and 6), the permanent magnet 30 comes into close proxmity to the pole pieces 31*b* and 32*b*, being attracted thereto magnetically and remains there until the coils of the electromagnets 31 and 32 are subjected to a new electrical pulse of opposite electrical polarity. At the point the entire action reverses from the description given above, viz., the pole pieces 31*b* and 32*b* are for that moment of like polarity as the permanent magnet 30, thereby repulsing it—while pole pieces 31*a* and 32*b* are of a polarity opposite to that of the permanent magnet 30, thereby attracting it. This causes the shutter 27 to swivel to the closed position—returning to that illustrated in FIG. 1.

It will be appreciated that the light emitting from a suitable light source, in the instance of the given illustration, a fluorescent tube 34, will pass through the lens 24 when the shutter 27 is opened and will cease to pass when the lens 24 is covered by the closed shutter 27. The lens is of special design and finish so that the entire viewing front—as illustrated in FIG. 5—is evenly illuminated, over a wide observation angle either left or right or up or down. This desirable performance is achieved by having a cylindrical shape in the upper portion and the cylindrical shape changing to a more arcuate configuration in the lower portion as at 24*a* (compare FIGS. 2, 4 and 6). More particularly, this is achieved by developing a second cylindrical curve in the lower portion generated about an axis at 90 degrees to that of the upper portion. Further, the back of the lens—that which is adjacent the light source is polished to a high transparent finish. This feature permits transmission of the light toward the curved front with relatively low energy loss. The entire front section of the lens is provided with a sandblasted finish which aids in scattering the internally transmitted light causing an evenly illuminated lens surface that may be observed from a wide angle. Other means for achieving the light scattering may be employed—other than the sandblasting previously referred to—but which, in any event, provide a rough or "matte" finish as contrasted to the smooth transparent finish of the rear end of the lens.

Turning now to the second drawing sheet, an alternative embodiment is pictured and wherein for convenience of understanding, like numerals are applied for to like parts except for the addition of 100. Thus, the subframe is generally designated 120 and is equipped with a central opening as at 123 (see FIG. 8). Projecting forwardly of the panel 121 is a lens generally designated 124 and which is equipped with a matte finish as indicated by the stippling at 124*b*. The inner end of the lens 124 is again smooth finished but is disposed at an angle A with respect to the vertical as at 124*a*. This compensates for the off-axis or off-center mounting of the fluorescent illuminating source 134.

Again, as with FIG. 1, the perspective view from the rear shows the shutter 127 in the closed condition while in FIG. 8 (generally corresponding to FIG. 2), the shutter 127 is in the open condition. Again, a permanent magnet as at 130 is affixed to the shutter 127. In the instance of the embodiment featured in FIGS. 7–11, there is a difference in the shape and mounting of the electromagnet means from that illustrated in the embodiment of FIGS. 1–6. In the case of this embodiment, a single electromagnet 131 (see FIG. 9) is provided. This is annular in nature and receives an annular shaped core 137 (see FIGS. 9 and 10), the rear end of which is equipped with a non-ferrous insert as at 138.

OPERATION OF SECOND EMBODIMENT

FIG. 1 shows the shutter 127 closed upon the annular shaped core 137 and non-ferrous insert 13—see particularly the exploded view in FIG. 9. This condition has resulted from the previous energizing of the electromagnet 131 with electrical polarity that turns pole piece 131*a* (see the central lower portion of FIG. 9) into a magnetic south pole while turning pole piece 131*b* into a magnetic north pole.

The polarity of the electromagnet 131 will act upon the polarity of the permanent magnet 130 by repelling the like poles, causing the shutter 127 to turn upon its hinge as at 128 (still referring to FIG. 9). Half-way through the pivot, the permanent magnet 130 will move within the proximity of the opposite polarity of the electromagnetic pole pieces 131*a* and 131*b*, and will remain in this position until reversal of the electromagnetic field—which will operate on the permanent magnet 130, causing the shutter 127 to open, as illustrated in FIG. 2.

Opening of the shutter 127 permits light from the fluorescent tube 134 or similar light source to fall upon the angled and polished end 124*a* of the lens 124 which will conduct this light to the opposite and frosted end of the lens 124 (as at 124*b*) causing it to glow in a bright fashion. Conversely, closing of the shutter 127 will stop the light from entering the lens, thereby darkening the protruding, frosted end of the lens.

While in the foregoing specification a detailed description of the invention has been set down for the purpose of illustration, many variations in the details hereingiven may be made by those skilled in the art without departing from the spirit and scope of the invention.

I claim:

1. A component for a module adapted to selectively pass light to provide a portion of alpha-numeric information comprising a subframe adapted to be integrated into a module frame, said subframe having a shutter pivotally mounted on the rear thereof, illuminating means operably associated with said subframe adjacent the rear thereof, means associated with each component for pivoting the shutter thereof to provide a part of a preselected piece of information, said means including an electromagnet, a permanent magnet on each shutter, and actuating means remote from said subframe for actuating said electromagnet, each electromagnet being mounted on the rear of said subframe adjacent said shutter and equipped with pole-pieces arranged in close proximity to the permanent magnet of said shutter to oppose the magnetic field of said permanent magnet and pivot said shutter, each component being equipped with lens means forward of said shutter.

2. The structure of claim 1 in which said illuminating means is positioned in close proximity to said element and adjacent one side thereof, said lens means being constructed and arranged to compensate for the side positioning of said illuminating means.

3. The structure of claim 2 in which said lens means is generally hemi-cylindrical having an end adjacent said one side and a second end remote from said one side, said second end being generally arcuate to provide said compensation.

4. The structure of claim 2 in which said lens means is generally cylindrical with one end adjacent the rear of said element and one end adjacent the front of said element, said rear end being beveled to provide said compensation.

5. The structure of claim 2 in which said lens means projects beyond the forward side of said element.

6. A component for a module adapted to selectively pass light to provide a portion of alpha-numeric or like information comprising a subframe adapted to be integrated into a module frame, said subframe being equipped with a front panel which is vertically disposed, an opening in said panel and a lens projecting forwardly therethrough, illuminating means operably associated with said subframe on the rear side thereof, a shutter on the rear side of said panel adapted to pivot to selective open and close said opening relative to passage of light therethrough from said illuminating means, and magnet means on said subframe for selectively pivoting said shutter.

7. The structure of claim 6 in which said magnet means includes a permanent magnet on said shutter and a selectively actuatable electromagnet fixed on the rear of said subframe for opposing the permanent magnet polarity.

8. The structure of claim 7 in which said illuminating means is positioned above said opening, said lens being contoured to compensate for the off-axis positioning of said illuminating means.

9. The structure of claim 8 in which said lens is generally cylindrical with the rear end beveled to provide said compensation, said electromagnet being annularly disposed about said lens.

10. The structure of claim 8 in which said lens is generally hemi-cylindrical and has a vertical axis, the lower end of said lens being arcuately beveled to provide said compensation, said electromagnet being positioned below said opening and lens.

11. The structure of claim 10 in which means are provided on said subframe for limiting the pivoting movement of said shutter to less than 90 degrees.

12. The structure of claim 6 in which the front end of the lens has a matte finish.

* * * * *